US010704221B2

(12) United States Patent
Nolle et al.

(10) Patent No.: US 10,704,221 B2
(45) Date of Patent: Jul. 7, 2020

(54) LOCKABLE COMPOSITE MANHOLE COVER SYSTEM, APPARATUS AND METHOD

(71) Applicant: Trifect Composites, LLC, Buffalo, NY (US)

(72) Inventors: Eric R. Nolle, South Wales, NY (US); Erik V. Koch, Elma, NY (US)

(73) Assignee: Trifect Composites, LLC, Buffalo, NY (US)

( * ) Notice: Subject to any disclaimer, the term of this patent is extended or adjusted under 35 U.S.C. 154(b) by 13 days.

(21) Appl. No.: 15/808,429

(22) Filed: Nov. 9, 2017

(65) Prior Publication Data

US 2019/0136483 A1 May 9, 2019

(51) Int. Cl.
*E02D 29/14* (2006.01)

(52) U.S. Cl.
CPC ..... *E02D 29/1427* (2013.01)

(58) Field of Classification Search
CPC ..... E02D 29/1427
USPC ..... 404/25; 52/19, 20; 70/169
See application file for complete search history.

(56) References Cited

U.S. PATENT DOCUMENTS 845,182 A * 2/1907 Letts ..... E05B 65/006 70/168
858,781 A * 7/1907 Benedict ..... B60K 15/0409 70/169
2,436,016 A * 2/1948 Myers ..... F16J 13/08 220/248
2,693,100 A * 11/1954 Wiegel ..... E02D 29/1463 70/168
3,901,407 A * 8/1975 Mitchell ..... B60K 15/04 220/315
3,921,494 A * 11/1975 Coe ..... F16B 21/10 411/344
5,275,501 A * 1/1994 Amorese ..... F16J 13/08 404/25
5,394,650 A * 3/1995 Dean ..... B65D 90/10 16/308
5,533,641 A * 7/1996 Argandona ..... B65D 90/105 220/248
5,788,406 A * 8/1998 Hernandez ..... E02D 29/1409 404/25
5,950,368 A * 9/1999 Bradford ..... E02D 29/1418 220/484
6,739,796 B1 * 5/2004 Del Nero ..... E02D 29/1427 404/25

(Continued)

*Primary Examiner* — Thomas B Will
*Assistant Examiner* — Katherine J Chu
(74) *Attorney, Agent, or Firm* — Woods Oviatt Gilman LLP; Katherine H. McGuire, Esq.

(57) ABSTRACT

A lockable manhole cover system including a manhole cover and a locking mechanism attached to the bottom surface thereof and including a fixed end and an actuated end, each including locking pins movable between locked and unlocked positions. The actuated end includes a keyed lock. When in the locked position, the free ends of the locking pins extend beneath a flange prevent the cover from being lifted up. When the actuated side is moved to the unlocked position via the key, the locking pin free ends retract such that the cover is free to be lifted from the ring. On the fixed side, the locking pins are biased to move to their extended positions upon manual depression of a release stem located at the upper surface of the cover.

13 Claims, 7 Drawing Sheets

(56) References Cited

U.S. PATENT DOCUMENTS

| | | | | |
|---|---|---|---|---|
| 7,347,070 | B1 * | 3/2008 | Spector | B65D 55/14 404/25 |
| 7,887,252 | B1 * | 2/2011 | Wang | E02D 29/1427 404/25 |
| 7,896,574 | B2 | 3/2011 | Nolle et al. | |
| 8,132,436 | B2 * | 3/2012 | Dutilleul | E02D 29/1409 404/25 |
| 8,888,400 | B2 | 11/2014 | Nolle et al. | |
| 9,115,479 | B2 | 8/2015 | Nolle et al. | |
| 9,127,431 | B2 * | 9/2015 | Lanham | E05F 15/60 |
| 9,157,212 | B2 * | 10/2015 | Nolle | E02D 29/14 |
| 9,765,498 | B2 * | 9/2017 | Mitola | E02D 29/1427 |
| 2007/0081856 | A1 * | 4/2007 | DeGreef | E02D 29/1427 404/25 |
| 2017/0175356 | A1 * | 6/2017 | Zeloof | E02D 29/14 |

* cited by examiner

LOCKABLE COMPOSITE MANHOLE COVER SYSTEM, APPARATUS AND METHOD

BACKGROUND OF THE INVENTION

The present invention relates to a lockable composite manhole cover system, apparatus and method which enables quick attachment and removal of the manhole cover while providing an integrated, secure locking system to prevent unauthorized access to the underlying structure.

SUMMARY OF THE INVENTION

In one embodiment, the invention comprises a lockable manhole cover system including a manhole cover removably attached to a cover mounting ring having an outer flange for securing the ring to a surrounding structure such as an underground vault or concrete column, for example. The cover when attached to the ring will lie substantially flush with the surrounding area such as a road. A locking mechanism is attached to the bottom surface of the cover and includes a fixed end and an actuated end, each including at least one but preferably two locking pins which are movable between locked and unlocked positions. When in the locked position, the free ends of the locking pins extend beneath an inner flange extending radially inwardly on the inside surface of the ring thereby preventing the cover from being lifted up and off the ring. When moved to the unlocked position, the locking pins free ends retract and locate radially inwardly of the flange such that the cover (and locking mechanism which is mounted thereto) is free to be lifted from the ring.

On the actuated side, a lock extends through a hole in the cover and is accessible on the top (exposed) surface of the cover. A key is used to engage the lock and move the locking pins on the actuated side to the unlocked position. Springs bias the locking pins into their extended locked position such that removal of the key from the lock biases the locking pins into their extended, locked positions on the actuated side. The key includes a threaded cylinder allowing it to be removably threaded to the lock which allows the user to lift and manually manipulate the cover using the key and a handle attached to and extending from the key.

On the fixed side, a release having a main body portion with a stem is provided and is configured to be moved between engaged and released positions relative to the locking pins on the fixed side. When the locking pins are in the retracted position, the release body is moved to engage the locking pins on the fixed side and the stem extends above the top upper surface of the cover and is manually accessible to be selectively pushed down into the released position. When in the released position, the main body portion of the release disengages the locking pins on the fixed side which are biased by springs to move into their extended, locked position.

Additional objects, advantages and novel aspects of the present invention will be set forth in part in the description which follows, and will in part become apparent to those in the practice of the invention, when considered with the attached figures.

DESCRIPTION OF THE DRAWING FIGURES

The above-mentioned and other features and advantages of this invention, and the manner of attaining them, will become apparent and be better understood by reference to the following description of the invention in conjunction with the accompanying drawing, wherein:

FIGS. 1*a* and 1*b* are top perspective views of an embodiment of the invention with the manhole cover shown spaced above the cover mounting ring (FIG. 1A) and attached to the cover mounting ring (FIG. 1B);

FIGS. 2*a* and 2*b* are bottom and top perspective views of an embodiment of the cover, respectively;

FIG. 3*a* is a bottom plan view of the cover mounted to the cover mounting ring with the locking mechanism shown in the locked position;

FIG. 3*b* is a cross sectional view of the cover and cover mounting ring seen in as taken through the line 3*b*-3*b* in FIG. 3*a;*

FIG. 4 is a fragmented bottom plan view of the fixed side of the locking mechanism with the locking pins shown in the extended, locked position;

FIGS. 5*a* and 5*b* are side elevational views of the locking pin with FIG. 5*b* rotated 90° about its longitudinal axis relative to FIG. 5*a;*

FIGS. 6*a* and 6*b* are opposite side perspective views of the fixed side (first) locking yoke of the locking mechanism;

Figure 11A:
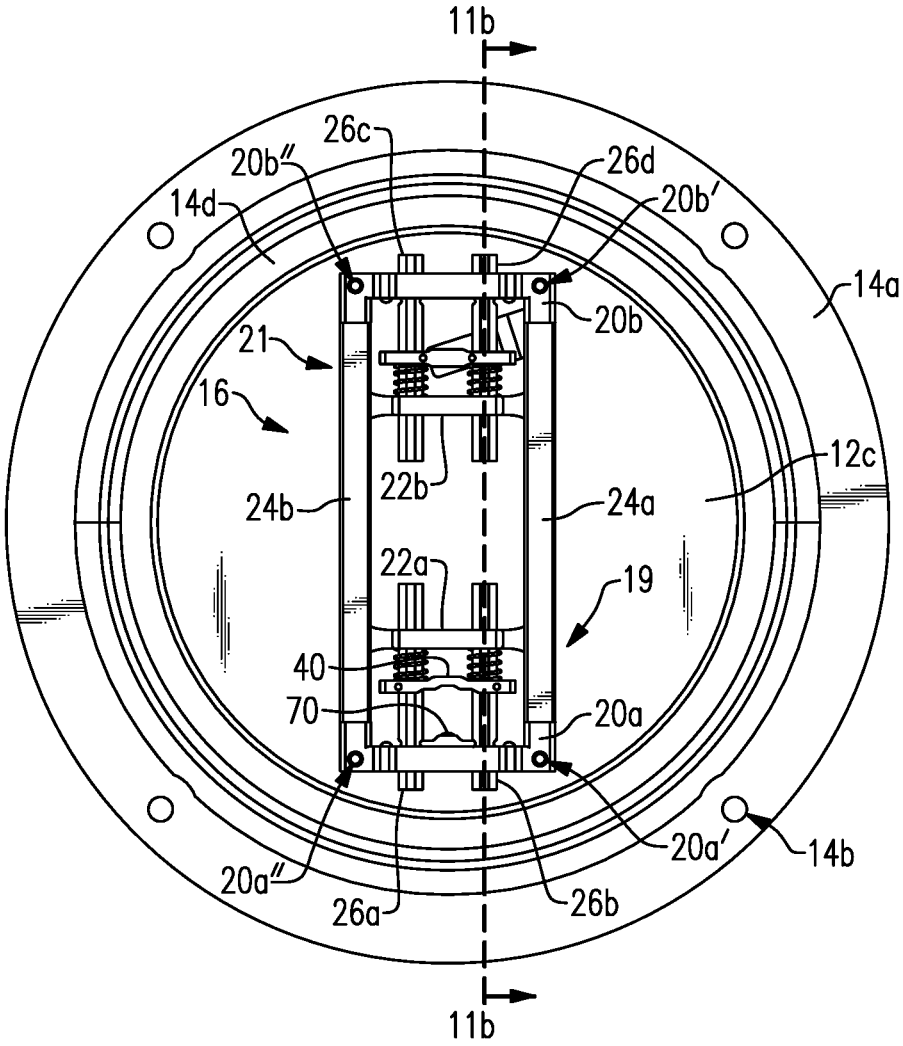
Figure 11B:
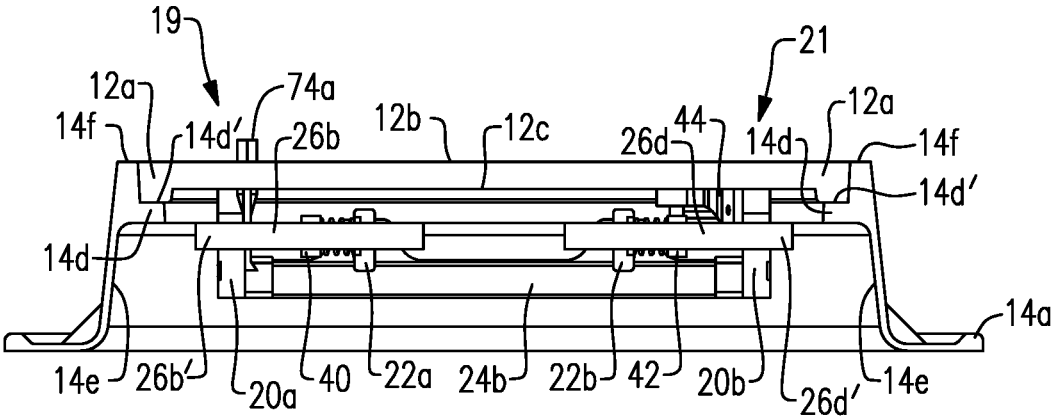

FIG. 11*a* is a bottom plan view of the cover mounted to the cover mounting ring with the locking mechanism shown in the locked position;

FIG. 11*b* is a cross sectional view of the cover and cover mounting ring seen in as taken through the line 11*b*-11*b* in FIG. 11*a;*

Figure 1A:
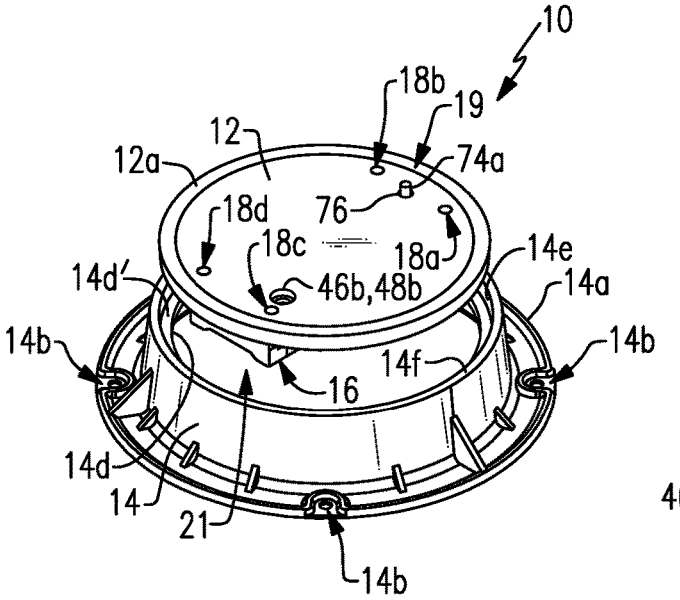
Figure 1B:
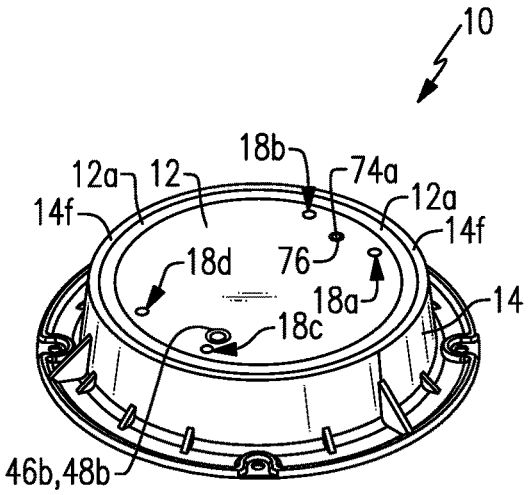
Figure 4:
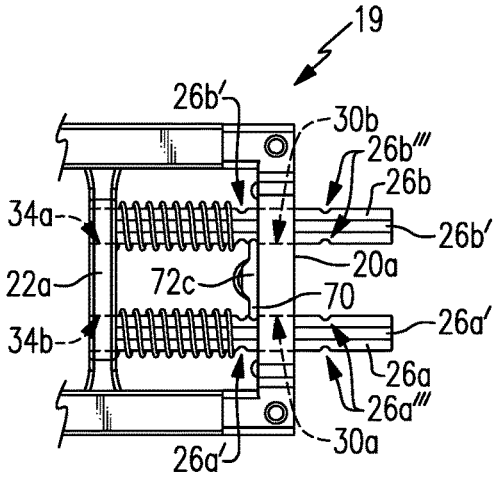
Figure 5A:
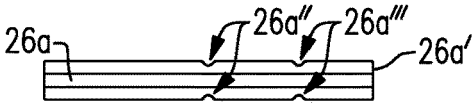
Figure 5B:
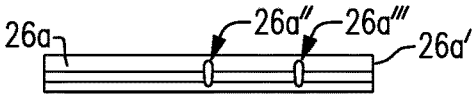
Figure 7:
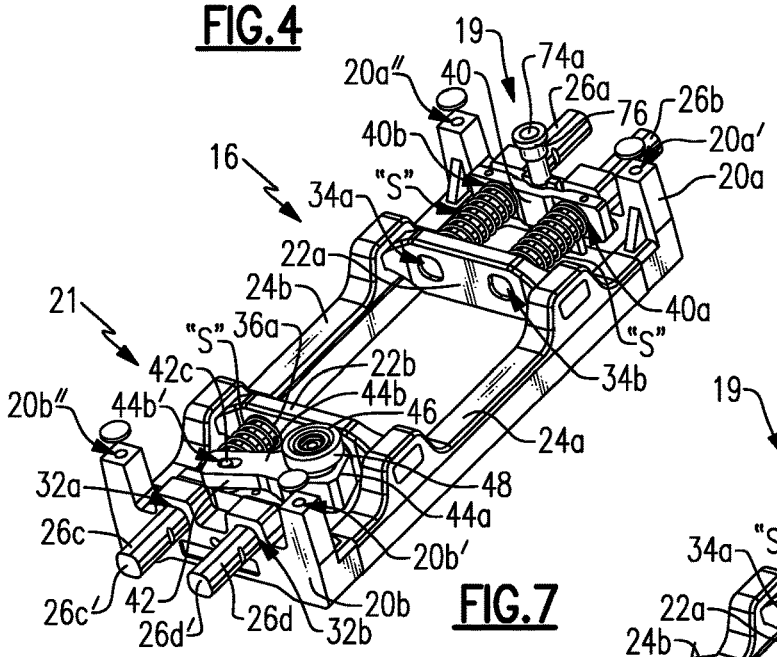
FIG. 7 is a top perspective view of the locking mechanism showing the locking pins in the extended, locked position.
Figure 9:
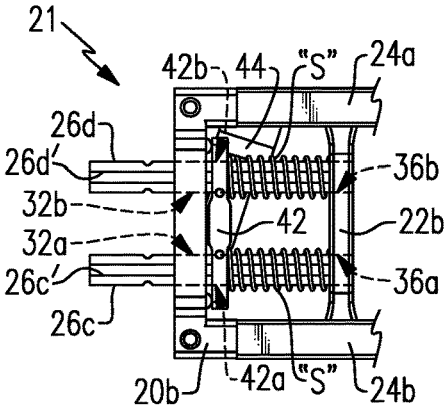
FIG. 9 is a fragmented bottom plan view of the actuated side of the locking mechanism with the locking pins shown in the extended, locked position.
Figure 10:
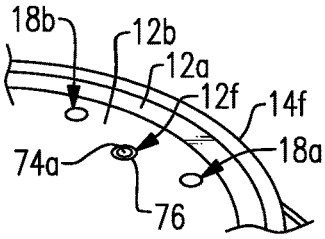
FIG. 10 is a fragmented view of FIG. 1*b* at the fixed side of the locking mechanism showing the fixed release button in the depressed position (disengaged from the locking pins which bias to return to their extended and locked position)
Figure 12:
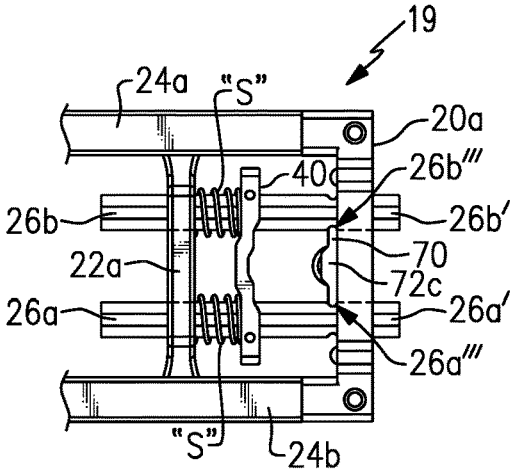
Figure 13:
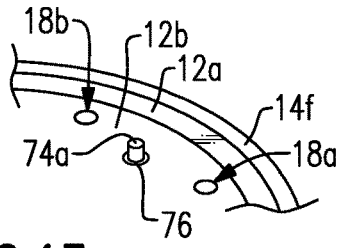
Figure 14A:
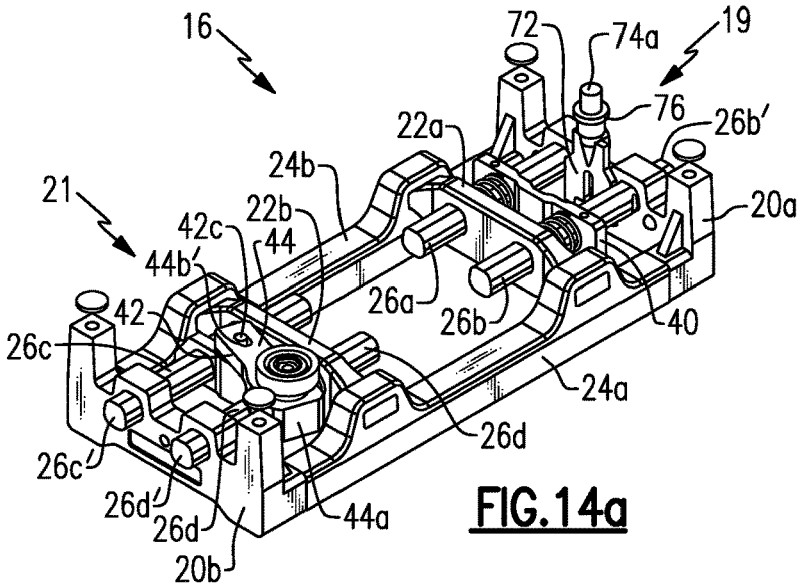
Figure 14B:
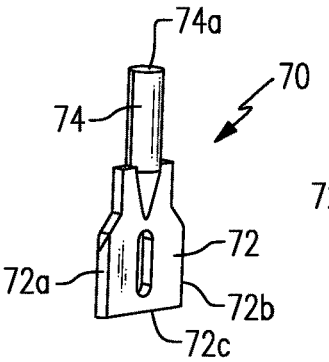
Figure 14C:
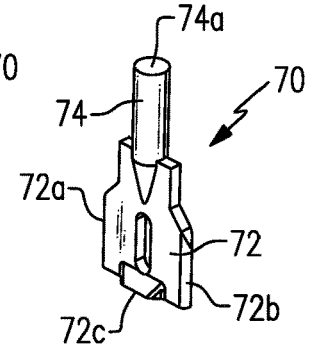
Figure 15:
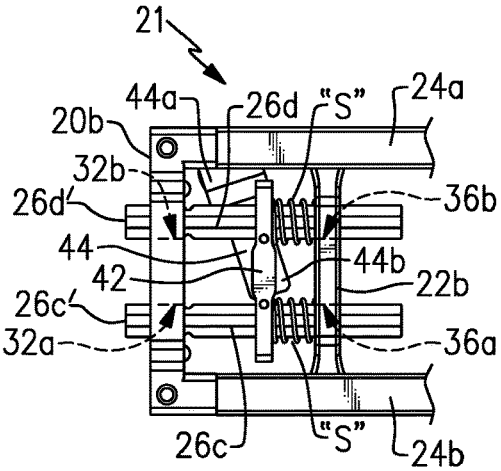
Figure 16A:
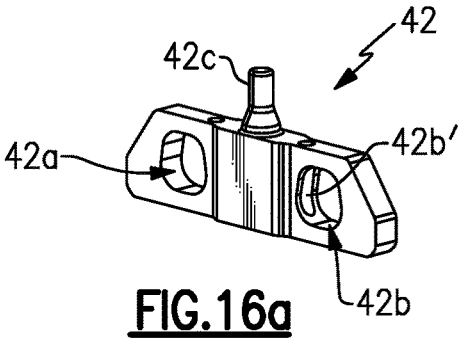
Figure 16B:
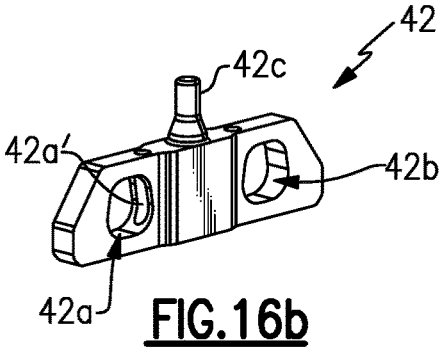
Figure 17A:
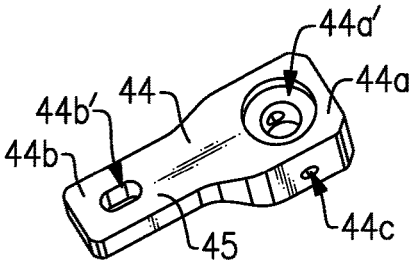
Figure 17B:
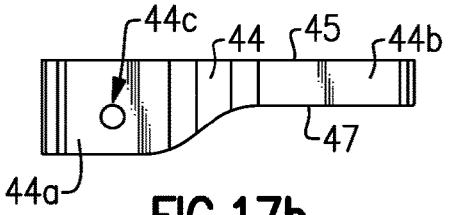
Figure 17C:
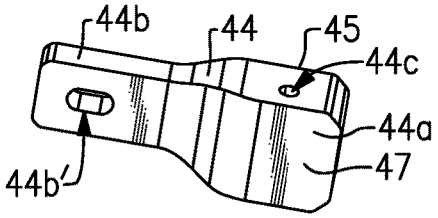
Figure 18:
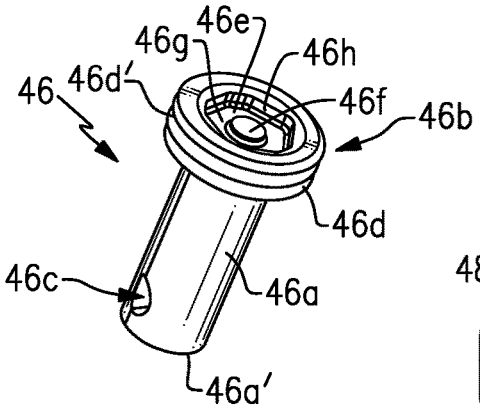
Figure 19A:
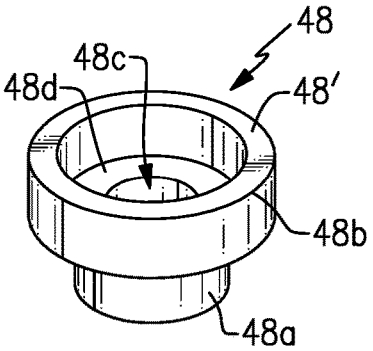
Figure 19B:
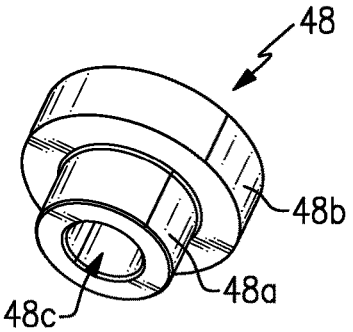
Figure 20:
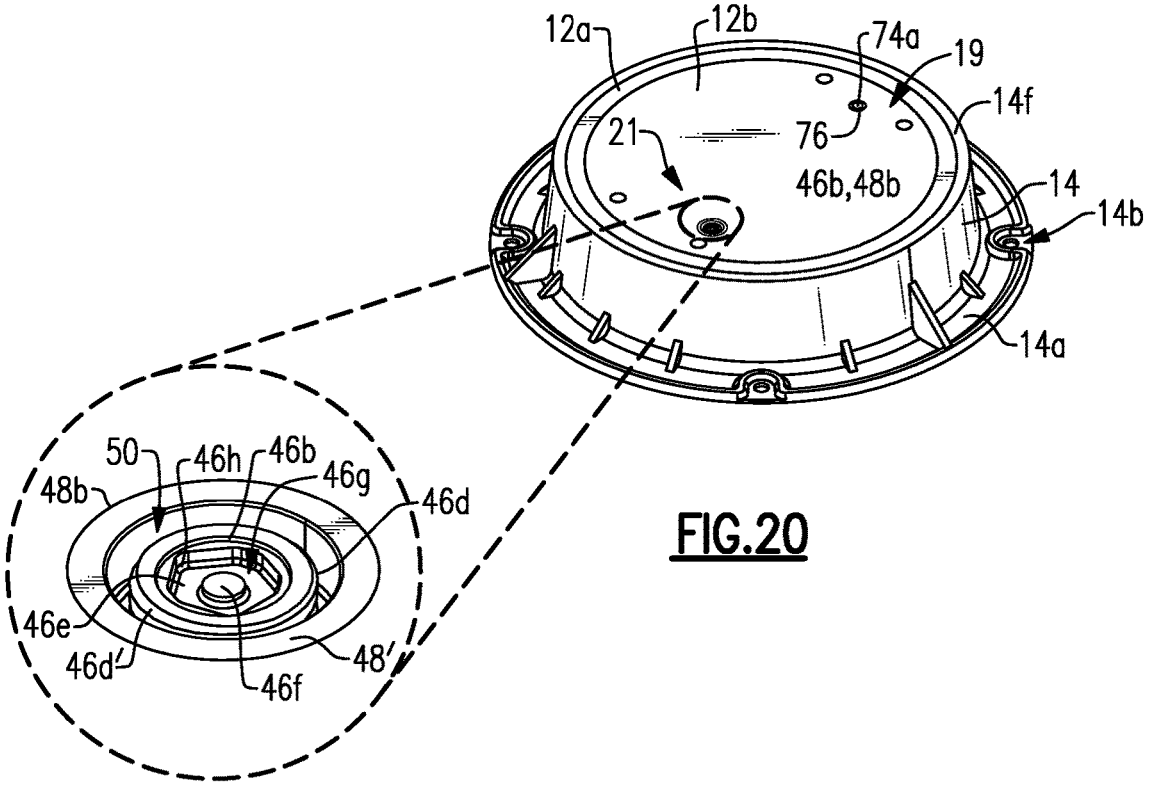
Figure 21B:
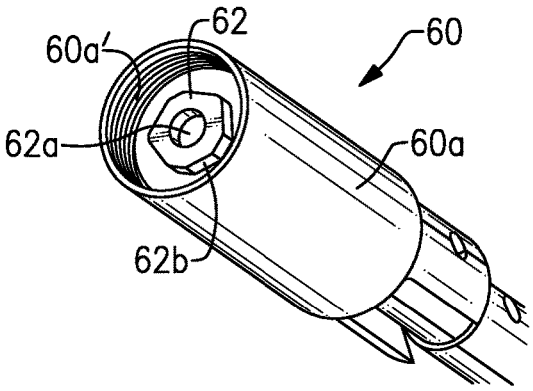
Figure 21A:
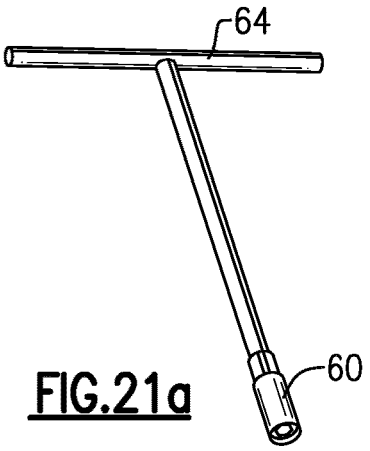

FIG. 12 is the view of FIG. 4 except with the locking pins shown in the retracted, unlocked position;

FIG. 13 is the view of FIG. 10 showing the fixed release button in the raised position (holding the locking pins in the retracted, unlocked position);

FIG. 14*a* is the view of FIG. 7 except with the locking pins in their retracted, unlocked position;

FIGS. 14*b* and 14*c* are opposite side perspective views of the fixed side release;

FIG. 15 is the view of FIG. 9 except with the locking pins in their retracted, unlocked position;

FIGS. 16*a* and 16*b* are opposite side perspective views of the actuated side (second) locking yoke;

FIGS. 17*a*, 17*b* and 17*c* are top perspective, side elevational and bottom perspective views of the actuating link, respectively;

FIG. 18 is a perspective view of the actuating bolt;

FIGS. 19*a* and 19*b* are top and bottom perspective views of the insert for the actuating bolt, respectively;

FIG. 20 is the view of FIG. 1*b* with a detail showing an enlarged view of the actuating bolt and insert located on the top surface of the cover; and FIG. 21*a* is a perspective view of the key and handle; and FIG. 21*b* is an enlarged perspective view of the key end of FIG. 21*a*.

DETAILED DESCRIPTION OF A PREFERRED EMBODIMENT

Referring now to the drawing, there is seen in FIGS. 1*a* and 1*b* an embodiment of the invention comprising a lockable manhole cover system 10 including a manhole cover 12 removably attached to a cover mounting ring 14 preferably made of a strong, durable metal such as cast iron, for example. Ring 14 includes a flange 14*a* having bolt holes 14*b* for securing ring 14 to a surrounding/underlying structure such as an underground vault or concrete column, for example, with the relative positioning being such that cover 12 will lie substantially flush with the surrounding area such as a road, for example (not shown). Cover 12 is preferably made of a composite material such as a molded high quality fiber glass and resin with a molded urethane perimeter edge 12*a* (which may be co-molded with the rest of cover 12 or formed separately and subsequently attached thereto), although other suitable materials are possible as may be desired.

Figure 2A:
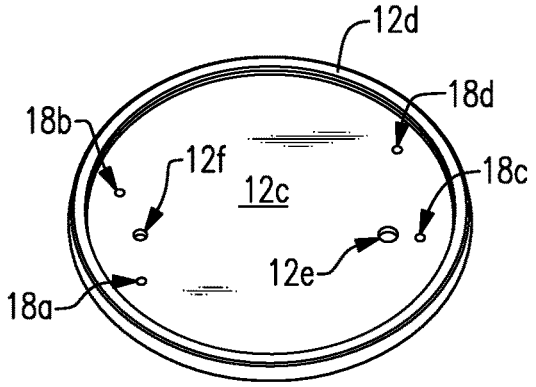
Figure 2B:
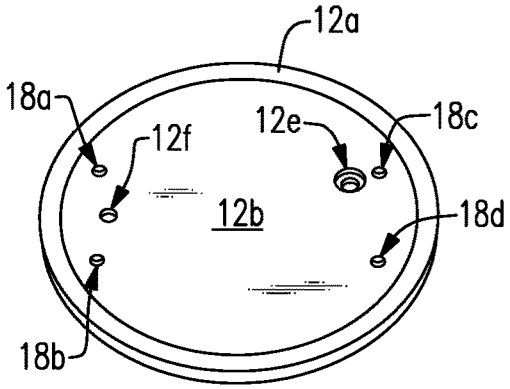

Cover 12 includes an upper surface 12*b* and lower surface 12*c* (see also FIGS. 2*a* and 2*b*). Ring 14 further includes an upper edge 14*f* and a flange 14*d* formed on and extending radially inwardly of inner wall 14*e* of ring 14 (see FIGS. 1*a*, 3*b* and 11*b*) thereby forming a cover locating area between flange 14*d* and said ring upper edge As seen in FIG. 3*b*, the distance $D_1$ between flange 14*d* and ring upper edge 14*f* is substantially the same as the thickness "$T_1$" of cover 12 at circumferential edge 12*a* such that cover top surface 12*b* sits substantially flush to ring upper edge 14*f* when cover 12 is fully seated on flange 14*d*.

Figure 3A:
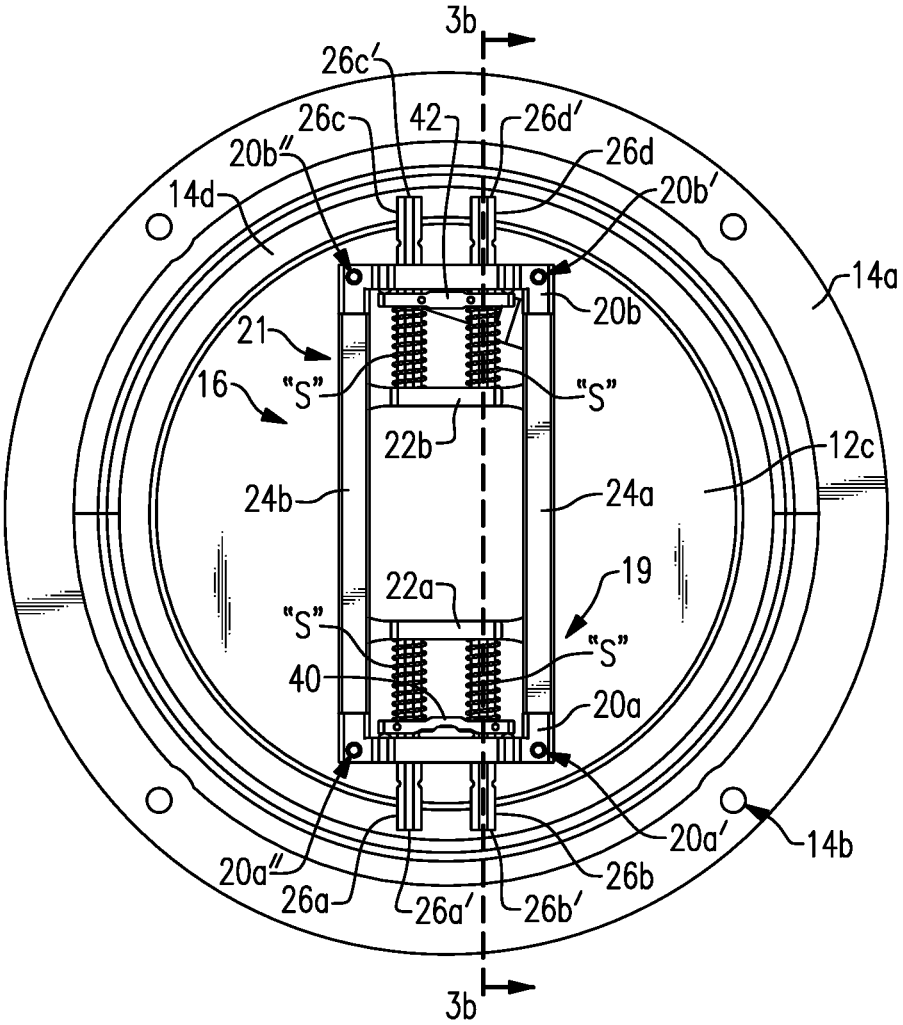
Figure 3B:
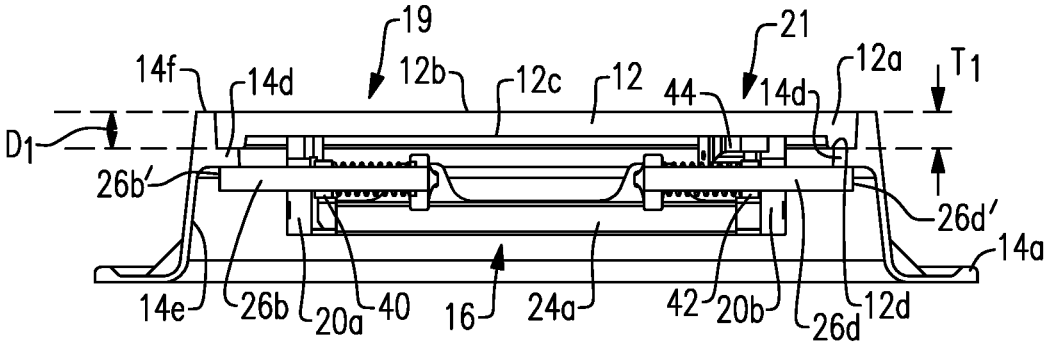

Locking mechanism 16 is mounted to the lower surface 12*c* of cover 12 with threaded bolts (not shown) which extend through cover 12 from upper surface 12*b* to lower surface 12*c*, with the threaded bolts threading through respective holes 18*a*, 18*b* and into respective aligned holes 20*a*', 20*a*" formed in first front stanchion 20*a*, and threading through respective holes 18*c*, 18*d* and into respective aligned holes 20*b*', 20*b*" formed in second front stanchion 20*b* (see also FIGS. 3*a* and 11*a*).

Locking mechanism 16 further includes first and second back brackets 22*a* and 22*b*, and first and second side trusses 24*a* and 24*b* which extend in spaced, parallel relation to each other and between which the front stanchions and back brackets extend and attach.

Locking mechanism 16 is considered to have two opposite ends referred to herein as the fixed end 19 and the actuated end 21. The actuated end 21 is referred to as such since it includes the keyed lock explained in detail below.

Figure 6A:
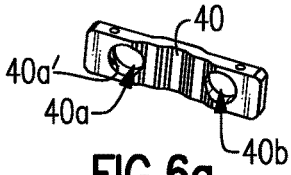
Figure 6B:
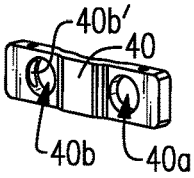
Figure 8:
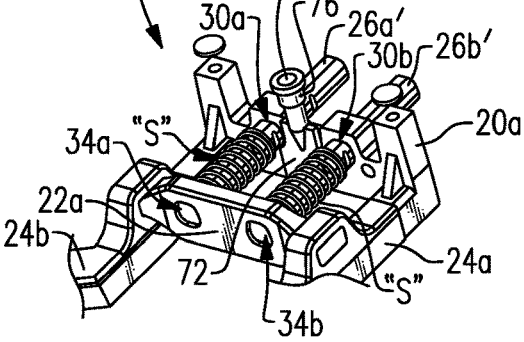
FIG. 8 is a fragmented view of the fixed side of the locking mechanism as seen in FIG. 7 with the fixed side (first) locking yoke removed to reveal the fixed side release for ease of description.

With reference to fixed end 19, first and second longitudinally spaced holes 30*a* and 30*b* are formed in first front stanchion 20*a* and these holes align with respective first and second longitudinally spaced holes 34*a*, 34*b* formed in first back bracket 22*a*. First and second locking pins 26*a* and 26*b* may freely and slidingly extend through respective aligned holes 30*a*, 34*a* and 30*b*, 34*b* in the first front stanchion 20*a* and first back bracket 22*a*. A first locking pin yoke 40 (FIGS. 6*a*, 6*b*) is provided having first and second longitudinally spaced holes 40*a* and 40*b* which align with respective aligned holes 30*a*, 34*a* and 30*b*, 34*b* in the first front stanchion and first back bracket. At least one but preferably two locking pins referenced herein as first and second locking pins 26*a* and 26*b* extend through respective holes 40*a* and 40*b* in a fixed, non-sliding manner via locking pin slots 26*a*" and 26*b*" engaging with respective, aligned flanges 40*a*' and 40*b*' located on the inwardly facing surfaces of holes 40*a* and 40*b*, respectively. As such, locking pins 26*a*, 26*b* move together with first locking pin yoke 40 for reasons explained in detail below. It is of course understood that other means of fixing locking pins 26*a* and 26*b* to first locking pin yoke 20*a* may be utilized as desired. First and second locking pins 26*a* and 26*b* each include a respective spring "S" mounted thereon between the first back bracket 22*a* and first locking pin yoke 40. It is noted that first locking yoke 40 is not shown in FIGS. 4 and 8 so as to reveal and describe other components which would be otherwise obscured by the first locking yoke in these figures.

With reference now to actuated end 21, first and second longitudinally spaced holes 32*a* and 32*b* are formed in second front stanchion 20*b* and these holes align with respective first and second longitudinally spaced holes 36*a*, 36*b* formed in second back bracket 22*b* (see FIGS. 7, 9, 14 and 15). At least one but preferably two locking pins referred to herein as third and fourth locking pins 26*c* and 26*d* may freely and slidingly extend through respective aligned holes 32*a*, 36*a* and 32*b*, 36*b* in the second front stanchion 20*b* and second back bracket 22*b*. A second locking pin yoke 42 (see also FIGS. 16*a* and 16*b*) is provided having first and second longitudinally spaced holes 42*a* and 42*b* which align with respective aligned holes 32*a*, 36*a* and 32*b*, 36*b* in the second front stanchion and second back bracket. Third and fourth locking pins 26*c* and 26*d* extend through respective holes 42*a* and 42*b* in a fixed, non-sliding manner via locking yoke flanges 42*a*' and 42*b*' engaging respective locking pin slots (not shown) on locking pins 26*c* and 26*d* in the same manner as described above regarding locking pins 26*a* and 26*b* engaging first locking yoke 40. As such, third and fourth locking pins 26*c*, 26*d* move together with second locking pin yoke 42 for reasons explained in detail below. Third and fourth locking pins 26*c* and 26*d* each include a respective spring "S" mounted thereon between the second back bracket 22*b* and second locking pin yoke 42.

Referring now to the keyed lock located at actuated end 21, second locking pin yoke 42 is seen to include a center post 42*c*. An actuating link 44 is provided and includes a base portion 44*a* and arm portion 44*b* extending from the base portion 44*a*. In one embodiment, an elongated slot 44*b*' extends through arm portion 44*b* from top surface 45 to bottom surface 47 thereof, and a counter sunk hole 44*a*' is formed into the top surface 45 of base portion 44*a*.

An actuating bolt 46 having a shank portion 46*a* and a head portion 46*b* is mounted to actuating link 44 via an insert 48 which fits within countersunk hole 44*a*' of the actuating link 44. Insert 48 includes a neck portion 48*a* and an annular head portion 48*b* with an insert shoulder 48*d* located radially inwardly of head portion 48*b*. A center through bore 48*c* is defined at the center of shoulder portion 48*d* and extends through the entire length of neck portion 48*a*. The shank portion 46*a* of actuating bolt 46 extends through center through bore 48*c* until actuating bolt head portion 46*b* is located on insert shoulder 48*d*. Actuating bolt shank portion 46*a* is longer than insert neck portion 48*a* such that the shank portion free end 46*a*' extends beyond insert neck portion 48*a*. A laterally extending though hole 46*c* is formed in actuating bolt 46 adjacent free end 46*a*' thereof. This through hole 46*c* aligns with actuating link through hole 44*c* whereby a pin (not shown) may be extended through aligned holes 46*c* and 44*c* to rotationally fix actuating bolt 46 to actuating link base portion 44*a*.

When locking mechanism 16 is mounted to cover 12 as explained above, the insert head portion 48*b* extends through cover hole 12*e* such that the insert head portion 48*b* and actuating bolt head portion 46*b* are exposed at cover top surface 12*b* with insert top surface 48' lying substantially flush with cover top surface 12*b* (see FIG. 20). Actuating bolt head portion 46*b* is exposed at cover top surface 12*b* and is coaxially positioned and spaced radially inwardly relative to insert head portion 48*b* such that an annular space 50 is formed therebetween. Actuating bolt head portion 46*b* includes an outer ring portion 46*d* having a threaded external surface 46*d'* (see also FIG. 18). A counter sunk surface 46*e* is located radially inwardly of outer ring portion 46*d* and a key registration boss 46*f* is located at the center of counter sunk surface 46*e* such that an annular space 46*g* is formed therebetween. The radially inwardly facing wall of outer ring portion 46*d* is formed as a non-rounded (e.g., polygonal) surface 46*h* so as to be able to removably engage the key 60 in a rotationally fixed manner as described below.

As seen in FIGS. 21*a* and 21*b*, a key 60 is provided having an outer cylinder portion 60*a* having internal threads 60*a'*. The outer cylinder portion 60*a* is freely rotatable with respect to a center lock head 62 having a center dimple 62*a* and external, non-round (e.g., polygonal) surface 62*b*. Key 60 may be used to turn actuating bolt 46 to lock and unlock cover 12 from ring 14. More particularly, key outer cylinder portion 60*a* is inserted into the space 50 between insert head portion 48*b* and actuating bolt head 46*b* while also locating dimple 62*a* onto registration boss 46*f* The inwardly facing, non-round surface 46*h* of the actuating bolt head 46*b* is complimentary shaped to the outwardly facing, non-round surface 62*b* of key center lock head 62. As such, these two surfaces may removably engage one another in a rotationally fixed manner. To attach key 60 to actuating bolt 46, cylinder portion 60*a* is turned such that the inner threaded surface 60*a'* of cylinder portion 60*a* threads to the outer threaded surface 46*d'* of actuating bolt outer ring portion 46*d* and thereby removably securing these two parts together. In other words, key 60 cannot be detached from actuating bolt 46 until cylinder portion 60*a* is manually rotated in the opposite direction to disengage these threaded surfaces from each other. This allows the user to use the key handle 64 to lift the manhole cover 12 from the ring 14 and carry and move the cover 12 about when the locking mechanism 16 is in the unlocked condition as will be described in more detail below.

Actuating link 44 is connected to second locking pin yoke 42 by inserting center post 42*c* through elongated slot 44*b'*. Rotation of actuating link 44 using key 60 causes center post 42*c* to slide within elongated slot 44*b'* in the manner of a cam. More particularly, the rotational movement of the actuating link 44 causes pivoting of actuating link arm portion 44*b* which is translated into linear movement of the second locking pin yoke 42 together with respective third and fourth locking pins 26*c*, 26*d* which, as explained above, are fixed to second locking pin yoke 42 but freely slide within their respective and aligned holes 32*a*, 36*a* and 32*b*, 36*b* formed in the second front stanchion 20*b* and second back bracket 22*b*. It is noted that slot 44*b'* is one of many possible configurations for creating a cam between actuating link 44 and second pin locking yoke 42. For example, slot 44*b'* may be eliminated and actuating link 44 may simply press directly against a portion of second locking pin yoke 42 such as post 42*c*.

When actuating link 44 is rotated in the clockwise direction, the second locking pin yoke 42 (and hence also third and fourth locking pins 26*c* and 26*d*) is moved toward second back bracket 22*b* which thereby compresses springs "S" located therebetween (see FIG. 15). When springs "S" are compressed, second locking pin yoke 42 is biased in the direction toward second front stanchion 20*b*. The movement of second locking pin yoke 42 toward second back bracket 22*b* retracts third and fourth locking pins 26*c* and 26*d* which removes their respective free ends 26*c'* and 26*d'* from beneath ring flange 14*d* and thereby allows cover 12 to be lifted from ring 14 using key 60 as described above. This is the unlocked condition of actuated end 21 of locking mechanism 16.

Turning attention now again to fixed end 19, as described above, first and second locking pins 26*a* and 26*b* are fixed to first locking pin yoke 40 and extend through and freely slide within aligned holes formed in first front stanchion 20*a* and first back bracket 22*a*. Springs "S" are mounted on first and second locking pins 26*a*, 26*b* between first back bracket 22*a* and first locking pin yoke 40. As seen best in FIGS. 14*b* and 14*c*, a fixed side release 70 is provided having a main body portion 72 and stem portion 74 extending from the body portion. Body portion 72 includes opposite side edges 72*a* and 72*b* which are sized to removably and slidingly engage the facing slots 26*a'''* and 26*b'''* (see FIG. 4) on the first and second locking pins 26*a* and 26*b*, respectively. Stem portion 74 telescopes through and freely slides within an insert 76 which remains stationary and is mounted within hole 12*f* (FIGS. 2*a*, 2*b*) formed through cover 12. Fixed side release 70 may be manually manipulated between a raised position and a depressed position relative to stationary insert 76 and cover 12 (it is noted that the term "manually" is to be broadly interpreted to include any means of applying a force without a tool). When moved to the raised position, the opposite side edges 72*a* and 72*b* slide into facing slots 26*a'''* and 26*b'''* thereby holding the locking pins in their retracted (unlocked) positions.

Once cover 12 has been initially mounted onto ring 14, the exposed free end 74*a* of stem portion 74 is raised above cover top surface 12*b* as seen in FIGS. 1*a* and 13. When ready to lock cover 12 to ring 14, the user manually pushes the stem portion 74*a* down against cover 12 which moves the release body side edges 72*a* and 72*b* out of locking pin slots 26*a'''* and 26*b'''*. The locking pins are then biased by the locking pin springs "S" into their extended, locked positions whereby locking pin ends 26*a'* and 26' locate beneath ring inner flange 14*d* as seen in FIGS. 3*a* and 3*b*. In this position, the stem free end 74*a* is substantially flush with insert 76 and cover top surface 12*b* (see FIGS. 1*b* and 10). As such, the stem is not accessible (either manually or with a tool) to be moved into a raised position until cover 12 is removed from ring 14 using the actuated side lock.

A worker (or other person) may alternately mount and remove lockable manhole cover system 10 to and from cover mounting ring 14 as follows:

Beginning from a mounted and locked position as seen in FIGS. 1*b*, 3*a* and 3*b*, the worker removes the protective cap (not shown) from actuating bolt head 46*b* and engage key 60 by inserting cylinder 60*a* into space 50 with key dimple 62*a* mounted over registration boss 46*f* and turning cylinder 60 clockwise until cylinder internal threaded surface 60*a'* threads to threaded surface 46*d'* of the actuating lock head 46*b*. This secures key 60 to the actuating bolt 46. Using handle 64, lock head 62 is rotated clockwise about 45° which in turn rotates actuating bolt 46 while cylinder 60*a* remains stationary. The clockwise rotation of actuating bolt 46 causes actuating link 44 to move second locking yoke 42, and thus also locking pins 26*c* and 26*d*, toward second backing bracket 22*b*. This movement retracts the locking pins 26*c* and 26*d* to the unlocked position where the locking pin free ends 26*c'* and 26*d'* are clear of ring flange 14*d* (see FIGS. 11*a*, 11*b* and 14*a*). The worker may put slight pressure on the key in a direction away from their body while turning the key which will cause the cover to tilt relative to ring 14.

Once tilted a couple of inches with the locking pin free ends cleared and raised above flange 14, while the cover is kept in this tilted position (by the worker keeping forward pressure on the key 60), the key is rotated in the opposite direction to its original position which extends the locking pins back toward their extended position. Since the locking pin free ends are above flange 14 at this point, this allows the worker to release the forward pressure on the key which moves the cover back toward the untilted position and the pin free ends on the actuated side 21 may then be seated on the top of flange 14. The worker may then use handle 64 to lift the cover 12 from the ring 14.

It will be appreciated that the locking pins 26*a* and 26*b* remain in their extended positions throughout the foregoing maneuvers, however, as the worker lifts the actuated side 21 from ring 14, the cover 12 is set at an angle relative thereto and the fixed side locking pin free ends 26*a*', 26*b*' may then be easily withdrawn from beneath ring flange 14*f*.

The worker may use handle 64 to lift and place the cover 12 upon its side on the ground with the handle 64 placed on the ground and cover attached to key 60 due to cylinder 60 remaining threadedly engaged to actuating bolt 46.

Removal of cover 12 from ring 14 as described above provides access to the underlying structure for any reason (e.g., to inspect an underground sewer line, to run underground cable, etc.). When ready to re-mount the cover 12 to the ring 14, the worker may first resets fixed side 19 to the unlocked (locking pins retracted) position by manually sliding first locking pin yoke 40 toward first backing bracket 22*a* which retracts first and second locking pins 26*a*, 26*b* while also compressing their respective springs "S". Once the locking pins 26*a*, 26*b* are moved to the point where their respective locking pin slots 26*a*''' and 26*b*''' are aligned with release 70, the release 70 is manually pushed at bottom edge 72*c* (see also FIGS. 14*b*, 14*c*) until the release body side edges 72*a* and 72*b* slide into and engage locking pin slots 26*a*''' and 26*b*''', respectively. In this position, the release stem 74*a* raises and extends above cover upper surface 12*b* (see FIGS. 11*b* and 13). The first locking pin yoke 40 may then be manually released and the locking pin yoke 40 and the locking pins 26*a*, 26*b* will stay in their retracted position against the bias of their respective springs "S" due to the engagement of the release side edges 72*a*, 72*b* in locking pin slots 26*a*''', 26*b*'''. The cover 12 is now ready to be (re) mounted to ring 14.

With key 60 still attached to actuating bolt 46 as described above, the worker uses handle 64 to drag cover 12 back to the ring 14 and seats the fixed side 19 onto flange 14*d* with fixed side locking pins 26*a* and 26*b* still in their retracted (unlocked) positions. Since these first and second locking pins 26*a* and 26*b* are retracted, their respective free ends 26*a*', 26*b*' clear the flange 14*d* and locate below but radially inwardly of the flange 14*d* as seen at fixed side 19 in FIGS. 11*a* and 11*b*.

On the actuated side 21, since at this point in the cover (re)mounting process the actuated side locking pins 26*c*, 26*d* are still in their extended positions, the free ends 26*c*', 26*d*' thereof seat and rest upon the upper surface 14*d*' of flange 14*d*. The worker may then turn key 60 clockwise to move the locking pins 26*c*, 26*d* toward their retracted positions and, once clear of flange 14*d*, the actuated side 21 of cover 12 falls by gravity until cover edge 12*a* fully seats upon flange 14*d*. The worker then removes key 60 from actuating bolt 46 by unthreading cylinder 60*a* from actuating bolt head portion 46*b* and lifting key 60 away from cover 12.

At the actuated side 21, the springs "S" when compressed bias the second locking yoke 42 toward the second stanchion 20*b* which thereby also biases the third and fourth locking pins 26*c*, 26*d* into their extended positions. In this position, the locking pin free ends 26*c*' and 26*d*' extend beneath flange 14*d* as seen at actuated side 21 in FIGS. 3*a* and 3*b*. With the cover 12 thus fully seated on ring flange 14*d*, the worker may then push down (e.g., by stepping upon) the release free end 74*a* which withdraws release body side edges 72*a* and 72*b* from the first and second locking pin slots 16*a*''', 26*b*'''.

Once release 70 is disengaged from locking pins 26*a*, 26*b*, the bias of springs "S" on fixed side 19 cause first locking yoke 40 and thus also locking pins 26*a*, 26*b* to move toward first stanchion 20*a* until locking pin free ends 26*a*', 26*b*' become located beneath flange 14*d*. A removable protective cap (not shown) may be installed over the actuating bolt head 46*b* by pressing the cap into the space 50. It will thus be appreciated that with now each of the first, second, third and fourth locking pin free ends 26*a*', 26*b*', 26*c*' and 26*d*' located beneath flange 14*d*, cover 12 is effectively locked to ring 14 as seen in FIGS. 3*a* and 3*b* and cannot be removed therefrom without the use of key 60 in the manner described above.

While this system, method and apparatus has been shown and described with reference to certain preferred embodiments thereof, it will be understood by those skilled in the art that various changes in form and details may be made therein without departing from the spirit and scope of the invention as described.

What is claimed is:

1. A lockable manhole cover system, comprising:

a) a manhole cover having upper and lower surfaces and a circumferential edge;

b) a manhole cover mounting ring having an upper edge and an inner wall surface with a flange formed on and extending radially inwardly of said ring inner wall surface, said flange spaced below said ring upper edge and thereby defining a cover locating area between said flange and said ring upper edge;

c) a cover locking mechanism attached to said cover lower surface, said locking mechanism having an actuated side having a keyed lock and a fixed side, wherein said fixed side comprises:

(i) at least one locking pin movable between extended and retracted positions, said at least one locking pin having a free end located adjacent said cover circumferential edge;

(ii) a first locking pin yoke fixedly attached to and movable with said at least one locking pin between said extended and retracted positions, said first locking pin yoke being biased to move said at least one locking pin to the extended position;

(iii) a release having a release body and a stem extending from said release body, said release body selectively and releasably engageable with said at least one locking pin when said locking pin is moved to the retracted position via movement of said first locking pin yoke, said release operable to maintain said at least one locking pin in the retracted position while engaged therewith, said release stem having a free end slidingly extendable through a hole formed in said cover whereby said stem, when said release is in the engaged position, extends above said cover upper surface and whereby a force may be selectively applied against said stem free end in a direction against said cover upper surface to cause said stem free end to lie flush with said cover upper surface and simultaneously cause said release to disengage from said at least one locking pin; and wherein said actuated side comprises:

(iv) at least one locking pin movable between extended and retracted positions, said at least one locking pin having a free end located adjacent said cover circumferential edge;

(v) a second locking pin yoke fixedly attached to and movable with said at least one locking pin on said actuated side;

(vi) a rotatable actuating bolt, said actuating bolt having an actuating bolt head portion extending through a hole formed in said cover whereby said actuating bolt head portion is accessible at said cover upper surface, said rotatable actuating bolt connected to said second locking pin yoke whereby rotation of said actuating bolt causes movement of said second locking pin yoke and said at least one locking pin on said actuated side; and d) a key having a key head attached to a handle, said key head having a polygonal surface for selective engagement with said actuating bolt head portion, whereby rotation of said key when said key head is engaged with said actuating bolt head portion causes rotation of said actuating bolt and said second locking pin yoke to selectively move said at least one locking pin on said actuated side between said extended and retracted positions; and whereby when said cover is positioned in said cover mounting area and said at least one locking pin on said fixed side and said at least one locking pin on said actuated side are in their extended positions, the respective free ends of each said at least one locking pins extend beneath said cover mounting ring flange on the said thereof opposite said cover mounting area and thereby prevent lifting of said cover from said cover mounting ring, and whereby upon clockwise rotation of said actuating bolt with said key, said second locking pin yoke moves said at least one locking pin on the actuated side to the retracted position wherein the free end of said at least one locking pin on the actuated side locates radially inwardly in a direction away from said flange and said ring inner wall surface and thereby allows said cover to be lifted from said cover mounting ring wherein said at least one locking pin on said fixed side is comprised of first and second locking pins extending in spaced, parallel relation to one another, and said at least one locking pin on actuated side is comprised of third and fourth locking pins extending in spaced, parallel relation to one another and wherein said first locking pin yoke is fixedly attached to and movable together with said first and second locking pins on said fixed side, and said second locking pin yoke is fixedly attached to and movable together with said third and fourth locking pins on said actuated side; and wherein said first and second locking pins each include a slot which face each other and said release body includes first and second side edges which are configured to removably slide into engagement with said facing slots, respectively, when said first and second locking pins are in their retracted positions and said release is moved to said engaged position.

2. The lockable manhole cover system of claim 1, wherein said cover locking mechanism on said fixed side further comprises a first stanchion and a first back bracket located in spaced relation to each other, said at least one locking pin slidingly extending through respective aligned holes formed in said first stanchion and said first back bracket.

3. The lockable manhole cover of claim 2, wherein said cover locking mechanism on said actuated side further comprises a second stanchion and a second back bracket located in spaced relation to each other, said at least one locking pin on said actuated side slidingly extending through respective aligned holes formed in said second stanchion and said second back bracket.

4. The lockable manhole cover of claim 1 wherein said cover locking mechanism on said fixed side further comprises a first stanchion and a first back bracket located in spaced relation to each other, said first and second locking pins slidingly extending through respective and aligned holes formed in said first stanchion and said first back bracket.

5. The lockable manhole cover of claim 4, wherein said cover locking mechanism on said actuated side further comprises a second stanchion and a second back bracket located in spaced relation to each other, said third and fourth locking pins on said actuated side slidingly extending through respective and aligned holes formed in said second stanchion and said second back bracket.

6. The lockable manhole cover of claim 5 wherein said second locking pin yoke is biased to move said third and fourth locking pins on said actuated side to the extended position.

7. The lockable manhole cover of claim 6 wherein the bias on said first locking pin yoke and said second locking pin yoke is provided by a spring mounted to each of said first and second locking pins between said first locking pin yoke and said first back bracket on said fixed side, and to each of said third and fourth locking pins and between said second locking pin yoke and said second back bracket on said actuated side.

8. A lockable manhole cover system, comprising:

a) a manhole cover having upper and lower surfaces and a circumferential edge;

b) a manhole cover mounting ring having an upper edge and an inner wall surface with a flange formed on and extending radially inwardly of said ring inner wall surface, said flange spaced below said ring upper edge and thereby defining a cover locating area between said flange and said ring upper edge;

c) a cover locking mechanism attached to said cover lower surface, said locking mechanism having an actuated side having a keyed lock and a fixed side, wherein said fixed side comprises:

(i) at least one locking pin movable between extended and retracted positions, said at least one locking pin having a free end located adjacent said cover circumferential edge;

(ii) a first locking pin yoke fixedly attached to and movable with said at least one locking pin between said extended and retracted positions, said first locking pin yoke being biased to move said at least one locking pin to the extended position;

(iii) a release having a release body and a stem extending from said release body, said release body selectively and releasably engageable with said at least one locking pin when said locking pin is moved to the retracted position via movement of said first locking pin yoke, said release operable to maintain said at least one locking pin in the retracted position while engaged therewith, said release stem having a free end slidingly extendable through a hole formed in said cover whereby said stem, when said release is in the engaged position, extends above said cover upper surface and whereby a force may be selectively applied against said stem free end in a direction against said cover upper surface to cause said stem free end to lie flush with said cover upper surface and simultaneously cause said release to disengage from said at least one locking pin; and wherein said actuated side comprises:

(iv) at least one locking pin movable between extended and retracted positions, said at least one locking pin having a free end located adjacent said cover circumferential edge;

(v) a second locking pin yoke fixedly attached to and movable with said at least one locking pin on said actuated side;

(vi) a rotatable actuating bolt, said actuating bolt having an actuating bolt head portion extending through a hole formed in said cover whereby said actuating bolt head portion is accessible at said cover upper surface, said rotatable actuating bolt connected to said second locking pin yoke whereby rotation of said actuating bolt causes movement of said second locking pin yoke and said at least one locking pin on said actuated side; and d) a key having a key head attached to a handle, said key head having a polygonal surface for selective engagement with said actuating bolt head portion, whereby rotation of said key when said key head is engaged with said actuating bolt head portion causes rotation of said actuating bolt and said second locking pin yoke to selectively move said at least one locking pin on said actuated side between said extended and retracted positions; and whereby when said cover is positioned in said cover mounting area and said at least one locking pin on said fixed side and said at least one locking pin on said actuated side are in their extended positions, the respective free ends of each said at least one locking pins extend beneath said cover mounting ring flange on the said thereof opposite said cover mounting area and thereby prevent lifting of said cover from said cover mounting ring, and whereby upon clockwise rotation of said actuating bolt with said key, said second locking pin yoke moves said at least one locking pin on the actuated side to the retracted position wherein the free end of said at least one locking pin on the actuated side locates radially inwardly in a direction away from said flange and said ring inner wall surface and thereby allows said cover to be lifted from said cover mounting ring, wherein said rotatable actuating bolt is connected to said second locking pin yoke by an actuating link interconnecting said actuating bolt to said second locking pin yoke;

wherein the connection between said actuating link and said second locking pin yoke is provided in the form of a cam;

wherein said actuating link includes a base portion and an arm portion extending from said base portion, said actuating bolt attached to said base portion, said arm portion engaging said second locking pin yoke as a cam whereby rotation of said actuating bolt causes said arm portion to pivot and cause linear movement of said second locking pin yoke; and wherein said arm portion includes an elongated slot and said second locking pin includes a center post which extends through said slot and together form said cam.

9. The lockable manhole cover of claim 8 wherein said base portion includes a counter sunk hole and said actuating bolt includes a shank portion which extends through said counter sunk hole with said shank portion being fixedly secured to said base portion and said actuating bolt head portion extending above said counter sunk hole.

10. The manhole cover of claim 9 and further comprising an insert having a neck portion and an annular head portion with a shoulder defined therebetween, said insert including a center through bore extending through said neck portion, said insert mounted to said actuating link base portion in said counter sunk hole, said shank portion of said actuating bolt extending through insert center through bore with said actuating bolt head portion located on said insert shoulder, said actuating bolt shank portion extending beyond said insert neck portion.

11. The manhole cover of claim 10 wherein said key includes an internally threaded cylinder located radially outwardly of said key head portion, and whereby said actuating bolt head portion includes an outer ring portion and a counter sunk surface located radially inwardly of said outer ring portion, said actuating bolt head portion further including a key registration boss located at the center of said counter sunk surface with an annular space formed between said outer ring portion and said key registration boss.

12. The lockable manhole cover of claim 11 wherein said actuating bolt head portion includes an externally threaded surface located radially inwardly of said insert head portion and thereby forming a space therebetween, said cylinder located on said key configured for removable insertion into said space with said cylinder internally threaded surface threadedly engageable with said externally threaded surface on said actuating bolt head portion, whereby a user may pull on said key head portion in a direction away from said cover upper surface without said key head portion detaching from said actuating bolt head portion when said cylinder internally threaded surface is threaded to said actuating head portion externally threaded surface, and whereby a user may selectively unthread said cylinder from said actuating bolt allowing said key to be detached from said actuating bolt.

13. The lockable manhole cover of claim 12 wherein said key head portion includes a center lock head having a center dimple and an externally facing, non-round surface, and wherein said outer ring portion of said actuating bolt head includes an inwardly facing, non-round surface, whereby said key center lock portion is removably engageable with said actuating bolt head portion with said dimple located on said registration boss and said externally facing, non-round surface of said center lock head is complementarily shaped and removably engaged with said inwardly facing, non-round surface of said actuating bolt head portion thereby rotationally fixing said key to said actuating bolt head portion such that rotation if said key causes rotation of said actuating lock head portion.

* * * * *